US006570318B2

(12) United States Patent
Hageluken et al.

(10) Patent No.: US 6,570,318 B2
(45) Date of Patent: May 27, 2003

(54) COLOR CATHODE RAY TUBE AND GETTER ASSEMBLY

(75) Inventors: Ben Heinz Hageluken, Eindhoven (NL); Krishnekoemar Mahabir, Eindhoven (NL); Boudewijn Lodewijk Kropman, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 204 days.

(21) Appl. No.: 09/808,214

(22) Filed: Mar. 14, 2001

(65) Prior Publication Data

US 2001/0022493 A1 Sep. 20, 2001

(30) Foreign Application Priority Data

Mar. 16, 2000 (EP) ..... 00200957

(51) Int. Cl.[7] ..... H01J 31/00; H01J 17/24; H01J 19/70

(52) U.S. Cl. ..... 313/481; 313/553; 313/558

(58) Field of Search ..... 313/481, 553, 313/558, 2.1

(56) References Cited

U.S. PATENT DOCUMENTS

| | | | | |
|---|---|---|---|---|
| 4,230,966 A | | 10/1980 | Compen | 313/481 |
| 5,350,970 A | * | 9/1994 | Vennix et al. | 313/481 |
| 6,310,435 B1 | * | 10/2001 | Hageluken et al. | 313/481 |
| 6,452,322 B1 | * | 9/2002 | Mukuno et al. | 313/481 |

* cited by examiner

*Primary Examiner*—Michael H. Day
*Assistant Examiner*—Matt Hodges

(57) ABSTRACT

A color cathode ray tube and a getter assembly for use in such a cathode ray tube. The getter assembly comprises a conducting strip for contacting a high-voltage contact with a magnetic screening cone inside a cone portion of the tube. Due to the relatively large deflection angle of modern cathode ray tubes with flat display screens, the getter assembly has to be made smaller. The getter assembly of the invention has a notch for directly engaging the high voltage contact. In case of reworking during the manufacturing process, an operator can slide the new getter assembly with the aid of a special tool, from the neck side along the inner wall for engagement with the high-voltage contact.

15 Claims, 3 Drawing Sheets

COLOR CATHODE RAY TUBE AND GETTER ASSEMBLY

The invention relates to a colour cathode ray tube including an envelope having a cone portion, a magnetic screening cone extending within the cone portion, a high-voltage contact extending through the envelope in the cone portion, and a getter assembly having a conducting strip provided with a connection portion for detachably and electrically connecting the getter assembly to the high-voltage contact.

The invention also relates to a getter assembly for use in such a cathode ray tube.

A colour cathode ray tube and a getter assembly are known from U.S. Pat. No. 4,230,966. The colour television tube described in this document comprises an envelope having a cone portion, a neck portion and a display screen. Furthermore, a magnetic screen extends within the cone portion towards the neck portion. A high-voltage contact extends through the envelope in the cone portion and a metal strip is provided for electrically connecting the magnetic screen to the high-voltage contact. One end of the metal strip is provided with a getter. The metal strip and getter form a getter assembly. The function of the getter includes maintaining a sufficiently high vacuum level and providing a long lifetime of cathodes for the colour cathode ray tube. The metal strip of the getter assembly is provided with a central hole to engage with the high-voltage contact.

During production, a so-called frittable anode getter is normally used, which can be placed together with the getter assembly before assembling or fritting a display screen to the cone portion. However, to improve the total yield of the manufacturing process for the colour television tube, a certain percentage of the colour television tubes needs to be reworked in the manufacturing process. Therefore, the getter assembly in the cone portion has to be replaced via the neck portion. To this end, an operator inserts a specially adapted tongue via the neck portion and takes the getter assembly out of the tube. Thereafter, the operator reinserts the tongue again into the tube with a fresh getter assembly, manipulates the central hole of the metal strip of the getter assembly over the high-voltage contact, and then pulls the central hole around the high-voltage contact, thereby contacting the magnetic screen with the high-voltage contact. A disadvantage of the known colour cathode ray tube is that the neck portion may be damaged when the envelope is strongly curved, as is the case with shallow colour cathode ray tubes with a flat display screen.

It is an abject of the invention to improve the yield of the manufacturing process for the colour cathode ray tube. This object is achieved by a colour cathode ray tube in which the connection portion is formed by a notch provided in the conducting strip for detachably connecting the magnetic screening cone to the high-voltage contact, and the notch directly engages the high voltage contact. During reworking of the colour cathode ray tube, an operator can now easily replace the getter assembly and attach the conducting strip to the high-voltage contact by inserting the conducting strip with a tongue via the neck portion into the cone portion, with the notch directed towards the high-voltage contact, and by sliding the conducting strip over the inner wall of the cone portion so as to engage the notch with the high-voltage contact. Providing the conducting strip with a notch on one end of the conducting strip instead of with a central hole eliminates the necessity of first positioning the hole of the conducting strip over the high-voltage contact and secondly pulling the hole around a pin of the high-voltage contact. A further advantage is that a hole in the magnetic screening cone can be dispensed with because the sliding movement of the tongue and the conducting strip can be performed in a more limited space between the inner wall of the cone portion and the magnetic screening cone. Furthermore, because of the absence of this hole, the magnetic shielding performance and also the mechanical strength of the magnetic screening cone is improved. Also, this design of the conducting strip can be shorter and allows the design of shallow cathode ray tubes. Further advantageous embodiments are defined in the dependent claims.

In a preferred embodiment of the colour cathode ray tube according to the invention the conducting strip includes a conducting spring connected transversely to the conducting strip for electrically connecting the conducting strip to the magnetic screening cone. As the contacting spring is now transversely mounted on the conducting strip, a stiff and robust contact is made with the magnetic screen and the high-voltage contact.

In a further embodiment of the colour cathode my tube according to the invention the conducting strip is provided with a ridge transverse to the longitudinal axis of the conducting strip, so that the conducting strip can be detachably secured to the high-voltage contact.

In a further embodiment of the colour cathode ray tube according to the invention the mechanical force of the conducting strip acting on the high-voltage contact is increased by providing the strip with two bends positioned on both sides of the high-voltage contact and transversely to the longitudinal axis of the conducting strip, allowing a robust contact between the magnetic screening cone and the high-voltage contact.

In another embodiment of the colour cathode ray tube according to the invention two protrusions on the inner wall of the cone portion along the contour of the conducting strip prevent rotation of the conducting strip.

In a further embodiment of the colour cathode ray rube according to the invention, where the envelope also includes a neck portion and a display screen, the inner wall of the cone portion has at least one ridge directed from the neck portion toward the display screen. The two ridges on the inner wall of the cone portion enable an operator to slide the conducting strip of the getter assembly along the inner wall towards the high-voltage contact.

In a further embodiment of the colour cathode ray tube according to the invention the inner side of the cone portion has a resistive layer. This resistive layer serves to limit the effects of a possible electric flashover in the tube on the electronic circuits of the device which incorporates the colour cathode ray tube.

In a further embodiment of the colour cathode ray tube according to the invention one end of the conducting strip has two or more tongues, whereby the electrical contact between the resistive layer as well as the mechanical contact between the high-voltage contact and the conducting strip of the getter assembly is improved.

It is a further object of the invention to provide a getter assembly which can easily be replaced.

This object is achieved by a getter assembly having a getter, and a conducting strip provided with a notch for detachably connecting a magnetic screen cone to a high-voltage contact of the cathode ray tube, the notch being arranged for directly engaging the high-voltage contact.

These and other aspects of the invention are apparent from and will be elucidated with reference to the embodiments described hereinafter.

It should be noted that the drawings are meant to be schematical and are generally not drawn to scale.

Figure 1:
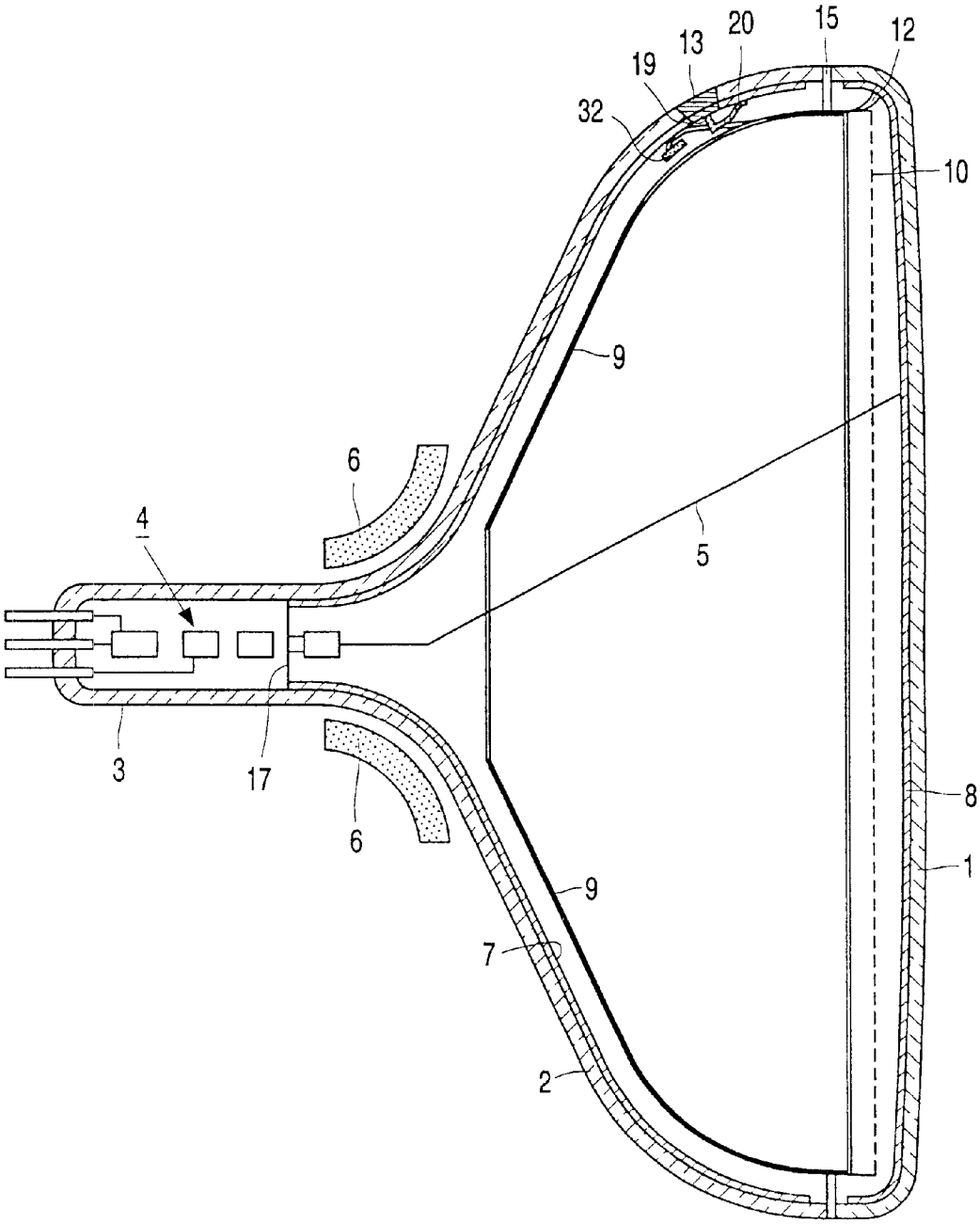
FIG. 1 is a schematic diagram of a cathode ray tube.

The cathode ray tube shown in FIG. 1 comprises an evacuated glass envelope with a neck 3, a cone 2 and a front panel 1, which may be either curved or flat. A display screen 8 having a pattern of, for example, lines or dots of phosphors luminescing in different colours (e.g. red, green and blue) may be arranged on the inner side of the panel 1. A thin mask 10 supported by a frame is positioned at a small distance from the display screen 8. The mask 10 may be an apertured mask having circular or elongate apertures, or a wire mask. During operation of the tube, an electron gun system 4 arranged in the tube neck 3 sends electron beams 5 through the mask 10 to the display screen 8 so that the phosphors will emit light. The electron beams have a small mutual angle causing, at the proper mask-to-screen distance, the electron beams to only impinge on the phosphors of the associated color. A deflection device 6 ensures that the electron beams systematically scan the display screen 8. The cathode ray tube further comprises an internal magnetic screen cone 9 which screens the electron beams 5 from the earth's magnetic field. The inner wall of the tube is covered with an approximately 10 micrometer thick resistive layer comprising approximately 6 parts by weight of iron ($Fe_2O_3$), 1 part by weight of graphite and 2.5 parts by weight of potassium silicate. The resistive layer 7 may be connected to a high-voltage contact 13 provided in the tube envelope 2 via a conducting strip, for example, a metal strip 20. The mask 10 is connected to the display screen 8 via contact springs 12, while the last electrode of the electrode system 4 is connected to the resistive layer 13 via the contact springs 17. As is known, after evacuating the tube, a layer of getter material of, for example, barium, strontium, calcium or magnesium is deposited in the tube so as to getter residual gases. A getter 32 from which the getter material is released by inductive heating may be detachably connected to the high-voltage contact 13 by means of the metal strip 20. The metal strip 20 and the getter 32 form a getter assembly. In this example, the dimensions of the metal strip are 49.5×14×0.25 mm.

Figure 2:
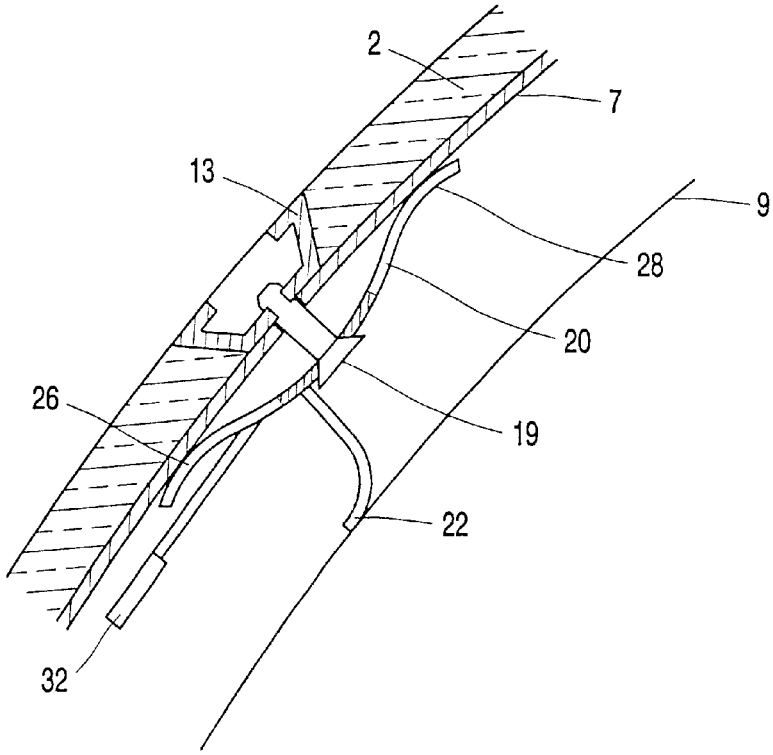
FIG. 2 shows a high-voltage contact and a getter assembly.
Figure 3:
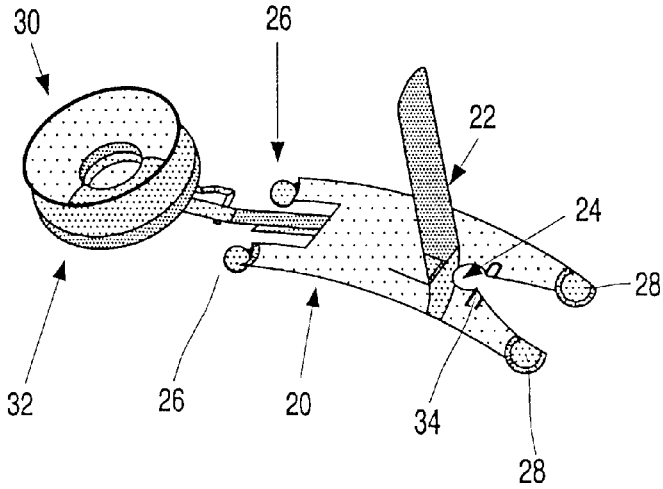
FIG. 3 shows an example of a getter assembly.

As is shown in FIG. 2 and FIG. 3, the high-voltage contact 13 between an external high-voltage power supply and the resistive layer 7 and also the magnetic screening cone 9 is provided with a conically widening contact pin 19 for cooperating with a notch 24 of the metal strip 20. The notch 24 in one end of the metal strip 20 is formed by two tongues 28. For engagement with the contact pin 19, the metal strip 20 is positioned on the inner wall 2 and, with a sliding movement, the notch 24 is engaged with the contact pin 19. Due to the resilience of the, preferably pre-bent, metal strip 20, the latter presses, at the area of the metal strip near the notch 24, against the conically widening contact pin 19.

As is shown in FIG. 3, the metal strip 20 is preferably provided with two tongues 26 for electrical contact between the resistive layer 7 and the high-voltage contact 13 and for improving the mechanical contact between the high-voltage contact 13 and the metal strip 20.

A metal contact spring 22 is welded perpendicularly to the metal strip 20. The contact spring 22 presses against the magnetic screening cone 9. In this manner, a direct electric connection between the magnetic screening cone 9 connected electrically to the mask 10 and the high-voltage contact 15 is obtained. Due to the perpendicular connection between the contact spring 22 and the metal strip 20, the contact force between the contact spring 22 and the magnetic screening cone 9 is increased. As a result, the electric connection between the mask 10 and the high-voltage contact 13 is improved. In this example, the dimensions of the metal contact spring are 42×6.5×0.15 mm.

Figure 4:
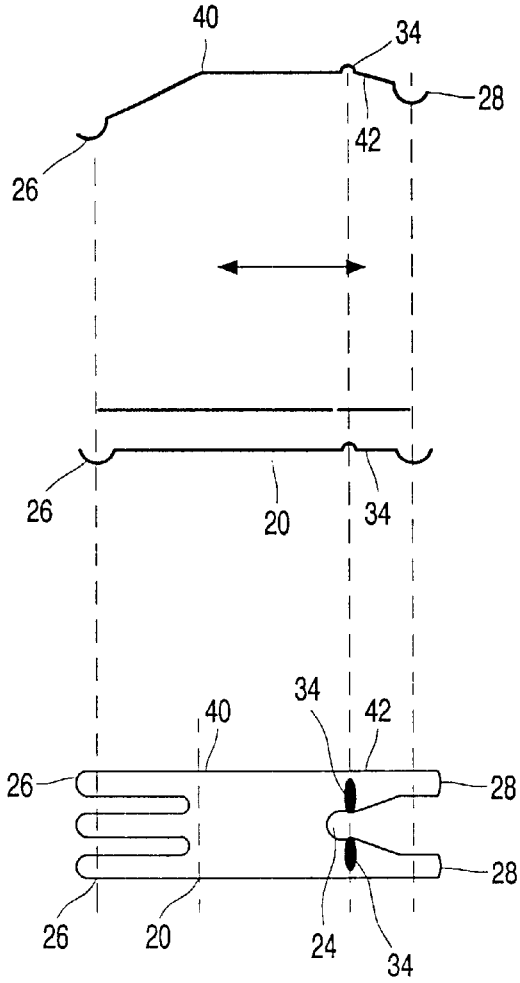
FIG. 4 is a top view of a getter assembly.

FIG. 4 is a top view of the metal strip. Furthermore, FIG. 4 is a first side view of the metal strip 20 in an unbent state and a second side view of the metal strip in a bent state. In the bent state, two bends 40,42 are formed transversely in the metal strip on both ends of the metal strip 20 and on both sides of the contact pin 19. The bends 40,42 increase the force of the metal strip 20 on the contact pin 19 so that the electrical contact is more robust. In order to detachably secure the metal strip 20 to the contact pin 19, the metal strip is provided with a ridge 34 transversely positioned on the tongues 28 of the metal strip 20 near the end of the notch cooperating with the contact pin 19.

In order to avoid rotation, the inner wall of the cone portion can be provided with protrusions or ridges along the longitudinal sides of the contour the metal strip 20.

Figure 5:
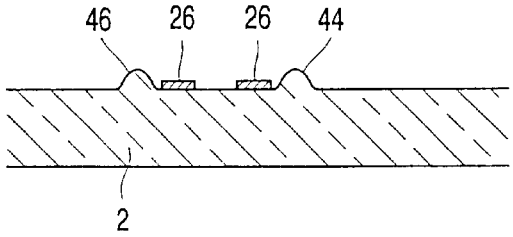
FIG. 5 is a cross-section of the getter assembly and the ridges at an inner wall of the cone portion of the cathode ray tube.

FIG. 5 is a cross-section the metal strip 20 through the tongues 26 and the ridges 44,46 on the inner side of the cone portion 2 of the envelope. These ridges 44,46 are positioned along the long sides of the contour the metal strip 20 and are directed from the neck portion 3 to the display screen 8. For cathode ray tubes which have to be reworked, the getter assembly has to be replaced. During remounting of the new getter assembly, these ridges 44,46 can also be used to guide the metal strip 20 to the high-voltage contact 13. To this end, an operator inserts the getter 32 and the metal strip 20 with a tongue via the neck portion 3 into the cone portion 2, with the notch 24 of the metal strip 20 directed towards the high-voltage contact 13, and slides the conducting strip 20 of the getter assembly via the rides 44,46 along the inner wall of the cone portion so as to engage the notch with the conically widened pin 19 of the high-voltage contact 13. In this way, there is a smaller risk of damage of the neck portion during remounting of the getter assembly.

What is claimed is:

1. A colour cathode ray tube comprising an envelope having a cone portion, a magnetic screening cone extending within the cone portion, a high-voltage contact extending through the envelope in the cone portion, and a getter assembly having a conducting strip provided with connection means for detachably and electrically connecting the getter assembly to the high-voltage contact, characterized in that the connection means are formed by a notch provided in the conducting strip for detachably connecting the magnetic screening cone to the high-voltage contact, said notch directly engaging said high voltage contact.

2. A colour cathode ray tube as claimed in claim 1, characterized in that the conducting strip is provided with a conducting spring connected transversely to the conducting strip for electrically connecting the conducting strip to the magnetic screening cone.

3. A colour cathode ray tube as claimed in claim 1, characterized in that the conducting strip is provided with a ridge transverse to a longitudinal axis of the conducting strip for detachably securing engagement of the conducting strip to the high-voltage contact.

4. A colour cathode ray tube as claimed in claim 1, characterized in that the notch is formed by two tongues at one end of the conducting strip.

5. A colour cathode ray tube as claimed in claim 1, characterized in that the conducting strip is provided with two bends positioned on both sides of the high-voltage contact and transversely to the longitudinal axis of the conducting strip for increasing the contact force between the high-voltage contact and the conducting strip.

6. A colour cathode ray tube as claimed in claim 1, characterized in that the inner wall of the cone portion is provided with two protrusions positioned along a contour of the conducting strip so as to avoid rotation of the conducting strip.

7. A colour cathode ray tube as claimed in claim 1, characterized in that the envelope also comprises a neck portion and a display screen, and the inner wall of the cone portion is provided with a ridge directed from the neck portion to the display screen for guiding the conducting strip towards the high-voltage contact during assembly.

8. A colour cathode ray tube as claimed in claim 1, characterized in that a resistive layer is provided on the inner side of the cone portion.

9. A colour cathode ray tube as claimed in claim 1, characterized in that one end of the conducting strip is provided with two tongues for contacting the resistive layer.

10. A getter assembly for dispensing a getter material in a cathode ray tube comprising a conducting strip and a getter, characterized in that the conducting strip is provided with a notch for detachably connecting a magnetic screen cone to a high-voltage contact of the cathode ray tube, said notch being arranged for directly engaging the high-voltage contact.

11. The getter assembly claimed in claim 10, characterized in that one end of the conducting strip is provided with two tongues for contacting a layer in the cathode ray tube.

12. The getter assembly claimed in claim 10, characterized in that the conducting strip is provided with a conducting spring connected transversely to the conducting strip for electrically connecting the conducting strip to the magnetic screening cone.

13. The getter assembly claimed in claim 10, characterized in that the conducting strip is provided with a ridge transverse to a longitudinal axis of the conducting strip for detachably securing engagement of the conducting strip to the high-voltage contact.

14. The getter assembly claimed in claim 10, characterized in that the notch is formed by two tongues at one end of the conducting strip.

15. The getter assembly claimed in claim 10, characterized in that the conducting strip is provided with two bends positioned on both sides of the high-voltage contact and transversely to the longitudinal axis of the conducting strip for increasing the contact force between the high-voltage contact and the conducting strip.

* * * * *